United States Patent [19]

Eisinger et al.

[11] 4,226,279

[45] Oct. 7, 1980

[54] METHOD OF SUPPRESSING FORMATION OF HEAT EXCHANGE FLUID PARTICLES INTO STANDING WAVES

[75] Inventors: Frantisek L. Eisinger, Demarest; Harry H. Pratt, West Orange, both of N.J.

[73] Assignee: Foster Wheeler Energy Corporation, Livingston, N.J.

[21] Appl. No.: 933,706

[22] Filed: Aug. 15, 1978

[51] Int. Cl.[3] ..... F28F 9/22

[52] U.S. Cl. ..... 165/1; 122/4 R; 165/134 R; 165/135; 165/160; 165/172; 165/183; 165/DIG. 13

[58] Field of Search ..... 165/171, 172, 183, 134, 165/135, 160, 161, DIG. 13, 1, 109; 122/6 A, 4 R

[56] References Cited

U.S. PATENT DOCUMENTS

| | | | |
|---|---|---|---|
| 2,029,437 | 2/1936 | Murray | 165/171 |
| 2,185,930 | 1/1940 | Simpson et al. | 165/183 |
| 2,444,908 | 7/1948 | Bailey et al. | 165/172 |
| 2,578,305 | 12/1951 | Huet | 165/183 |
| 2,650,802 | 9/1953 | Huet | 165/172 |
| 2,893,509 | 7/1959 | Baird | 165/134 |
| 3,263,654 | 8/1966 | Cohan et al. | 122/4 R |
| 3,265,040 | 8/1966 | Chen | 122/4 R |
| 3,279,535 | 10/1966 | Huet | 165/183 |
| 3,286,328 | 11/1966 | Anderson | 165/171 |
| 3,651,788 | 3/1972 | Chayes | 122/4 R |

FOREIGN PATENT DOCUMENTS

| | | | |
|---|---|---|---|
| 241225 | 10/1962 | Australia | 165/134 R |
| 1426641 | 9/1969 | Fed. Rep. of Germany | 122/6 A |
| 827519 | 4/1938 | France | 165/172 |
| 935409 | 6/1948 | France | 165/172 |
| 68802 | 9/1951 | Netherlands | 165/183 |
| 177035 | 5/1935 | Switzerland | 165/171 |
| 1441437 | 6/1976 | United Kingdom | 122/6 A |

*Primary Examiner*—Sheldon Richter

*Attorney, Agent, or Firm*—Marvin A. Naigur; John E. Wilson; John J. Herguth, Jr.

[57] ABSTRACT

A method of suppressing formation of heat exchange fluid particles into standing waves is provided. Pursuant to the method a plurality of metal fins attached to a plurality of tube sections extending within a shell are disposed within a heat exchanger shell such that the fins extend parallel to the tube sections and parallel to the direction of flow of fluid through the shell. The fins define with the tube sections a barrier adapted to interrupt movement of columns of fluid particles in a direction perpendicular to the direction of flow of fluid through the shell.

4 Claims, 13 Drawing Figures

FIG. 4
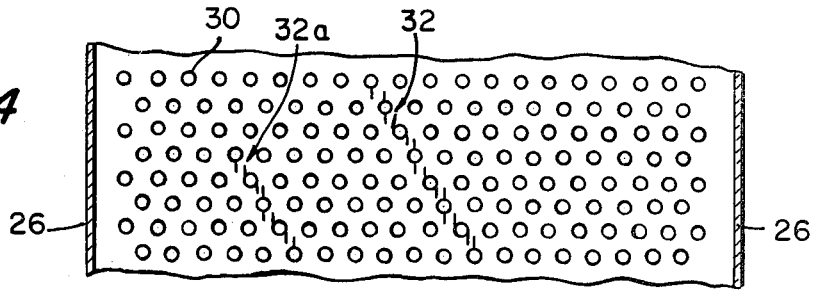
FIG. 5
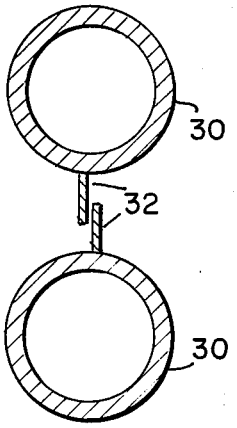
FIG. 6
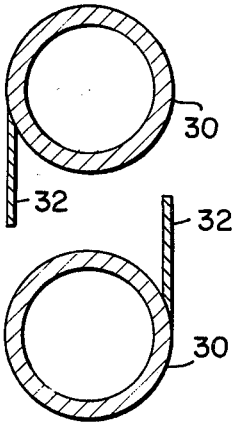
FIG. 7
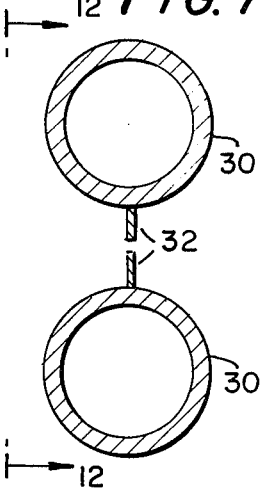
FIG. 8
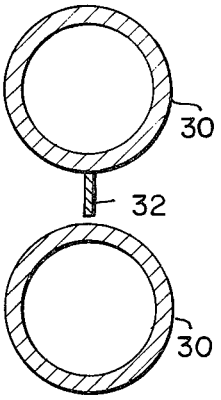
FIG. 9
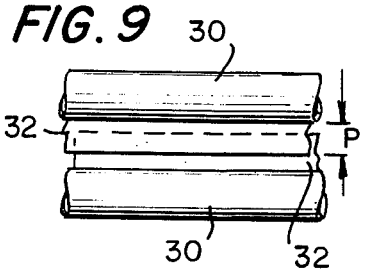
FIG. 10
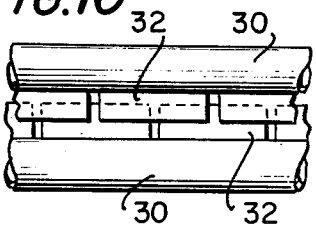
FIG. 11
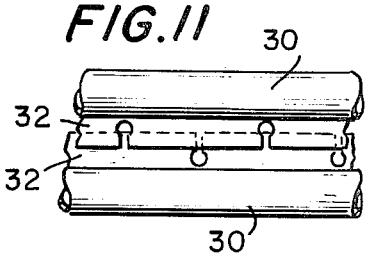
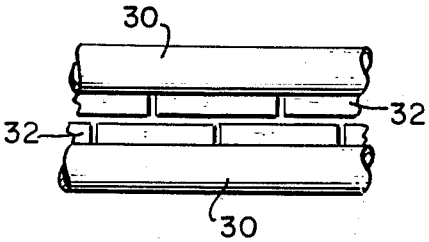
FIG. 12
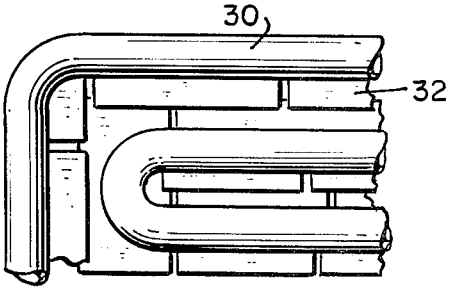
FIG. 13

METHOD OF SUPPRESSING FORMATION OF HEAT EXCHANGE FLUID PARTICLES INTO STANDING WAVES

BACKGROUND OF THE INVENTION

This invention relates to heat exchangers and more particularly, to heat exchangers of the type in which tube sections are disposed within a shell, duct or chamber, such as vapor generators, feedwater heaters, condensers, air preheaters, etc., wherein standing wave vibration can occur.

There are several causes for the creation of standing wave vibration, including a phenomenon known as "vortex shedding." When a fluid flows over the outside surface of tubes, the fluid will form into vortices, spinning in alternating clockwise and counterclockwise directions on opposite sides of the tubes after passing over the tube surfaces. The vortices form in a regular and periodic manner. When the tubes are disposed within a shell or chamber, the vortices create pressure pulsations which affect "columns" of the fluid which extend transversely of the direction of fluid flow in the direction perpendicular to the tube axes. The particles comprising the fluid columns are excited by the pressure pulsations, and can form into standing waves of particular frequencies. The frequency of a standing wave is a function of the width of the fluid column, being inversely proportional thereto and calculated in accordance with the following formula:

$$f = n\frac{C\sqrt{T}}{W}$$

where f=frequency in Hz, n=1, 2, 3, . . ., or other integer, representing the mode number, C=dimensional constant, T=fluid temperature in degrees Rankine, and W=width of the fluid column in feet.

When the excitation frequency (the frequency of the pressure pulsations) approaches or equals the natural frequency of a particular fluid column (the standing wave frequency for that column), that is, when resonance occurs, the fluid column will vibrate and depending upon the amplitude or intensity and frequency of the standing wave can manifest itself as noise.

It should be understood that vortex shedding is only one cause for standing wave vibration, and that several other causes exist, including fluid flow turbulence and tube vibration. Vortex shedding, fluid flow turbulence, and/or tube vibration can each result in pressure pulsations which propagate through the fluid and affect fluid columns in such a manner as to cause standing wave vibration. When two or more such causes occur simultaneously, for example if tube vibration occurred simultaneously with vortex shedding, a "coupling" effect can occur whereby tube vibration and vortex shedding will together contribute to the creation of standing wave vibration.

In addition to the creation of noise, standing wave vibration may cause vibration of the shell or chamber boundary walls, and can even result in damage to the tube elements.

In the past, standing wave vibration was prevented by installing baffles within the shell, duct or chamber which extended parallel to the direction of fluid flowing over the tube outer surfaces and perpendicular to the direction of the standing waves. This technique had the effect of altering the standing wave frequency by changing the dimension W, previously discussed. Baffles took the form of metal sheets disposed between longitudinally extending rows of tubes, and were fastened at their edges to the walls of the shell or even to the tubes themselves. Unfortunately, baffles may buckle, burn, or corrode when exposed to fluids at high temperatures. Furthermore, in some cases the orientation of the tubes forming a tube bank may not allow for locating baffles between tubes, which would be true for example in the case of the staggered tube array shown in FIG. 3 hereinafter. Additionally, the number of baffles that may be required to prevent standing wave vibration may be so high as to make the use of baffles quite costly.

The instant invention provides a method of operating a heat exchanger by which standing wave vibration is minimized, which can be employed regardless of the orientation of the tubes, and which prevents against the problems of buckling, burning, or corroding associated with baffles. Additionally, when compared against heat exchangers incorporating baffles, the invention is relatively inexpensive.

SUMMARY OF THE INVENTION

In accordance with an illustrative embodiment demonstrating the features and advantages of the present invention, there is provided a method of operating a heat exchanger including a chamber defined by a boundary wall and a plurality of tube sections disposed within the chamber. A first heat exchange fluid is passed through the chamber, over the outer surfaces of the tube sections. A second heat exchange fluid is passed through the tube sections. Fins are attached to tube sections and lie in a plane parallel to the direction of the first fluid flowing within the shell. The fins are arranged to interrupt the movement of the particles of the first fluid which are subjected to pressure pulsations and thereby suppress formation of such particles into standing waves.

BRIEF DESCRIPTION OF THE DRAWINGS

The above brief description as well as further objects, features and advantages of the present invention will be more fully appreciated by reference to the following detailed description of the preferred embodiment in accordance with the present invention when taken in connection with the accompanying drawings, wherein:

FIG. 4 is a sectional view similar to FIG. 2 and FIG. 3, but showing fins arranged to present a plurality of barriers to fluid movement;

FIG. 5 shows an alternative fin and tube arrangement of the instant invention, in which tube sections are aligned in the direction of fluid flowing within the gas pass, and closely arranged fins overlap one another in a direction perpendicular to fluid flow;

FIG. 6 shows another alternative embodiment of the fins of the invention being similar to FIG. 5 but wherein the fins are spaced further apart from one another;

FIG. 7 is another embodiment of the invention but wherein the fins are in line, with a nominal space existing therebetween;

FIG. 8 is yet another alternative embodiment of the fins of the invention wherein, in view of the closely spaced tube sections, the array will allow for use of a single fin between adjacent tube sections, with a nominal space existing between the free edge of the fin and the outside surface of an adjacent tube section;

FIG. 9 is a sectional view taken along line 9—9 of FIG. 2, wherein continuous fins are used to suppress standing wave formation;

FIG. 10 is a sectional view similar to FIG. 9 but wherein a plurality of small fins are used in lieu of continuous fins;

FIG. 11 is a view similar to FIGS. 9 and 10 but wherein a continuous slotted fin is used;

FIG. 12 is a sectional view taken along line 12—12 of FIG. 7 showing in line small fins running along the lengths of adjacent tube sections; and FIG. 13 is a blown-up view of a fin arrangement at the location of a tube return bend.

DESCRIPTION OF THE PREFERRED EMBODIMENT

Figure 1:
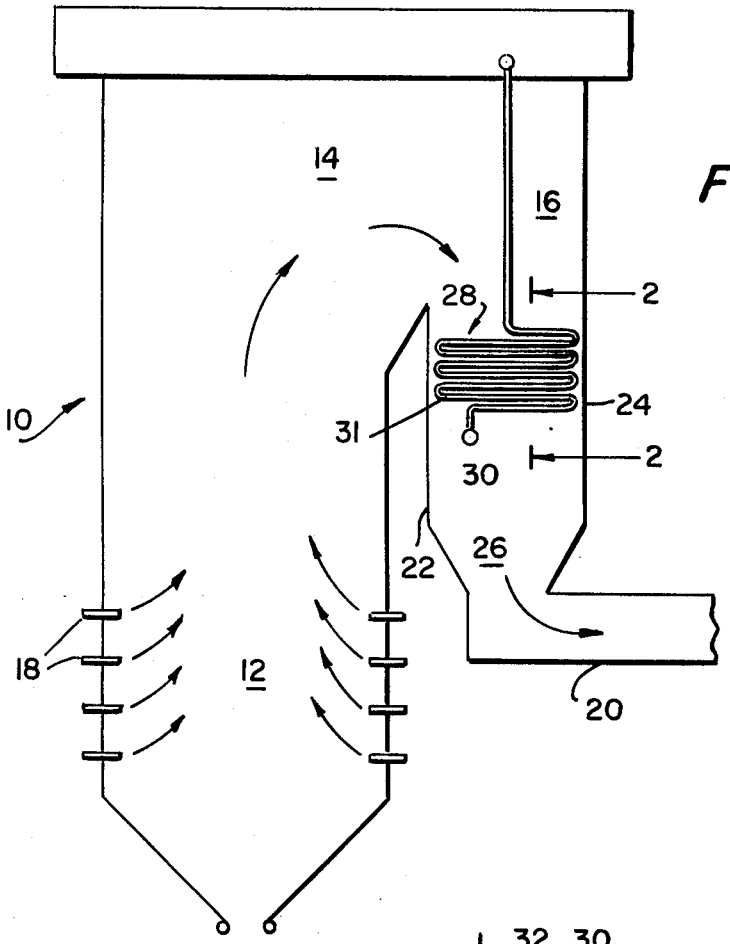
FIG. 1 is a schematic illustration of a vapor generator wherein the instant invention is employed in the rear gas pass area.

Referring to FIG. 1, there is shown a vapor generator 10 having a furnace section 12, vestibule section 14, and convection section 16, which is also known as a rear gas pass. It is to be understood that vapor generators including those of the type shown in FIG. 1, represent only one type of heat exchanger in which tubes are disposed within a shell, duct or chamber through which a heat exchange fluid is passed; it is contemplated that the instant invention can be used in other sections of the vapor generator 10, such as vestibule section 14, or in other heat exchangers, including condensers, feedwater heaters, air preheaters, etc.

Burners 18 introduce heated gases to furnace section 12 which thereafter rise, pass through vestibule section 14, pass down convection section 16, and then pass out through outlet 20. Convection section 16, also known as the rear gas pass, comprises a duct defined by front wall 22, rear wall 24, and side walls 26, only one of which is shown for convenience in FIG. 1. It should be understood that the duct, shell or chamber could be defined by a cylindrical, conical, or differently shaped member, and need not be rectangular. Disposed within convection section 16 is a heat exchange element 28, which could be for example an economizer, superheater, or reheater. It should be understood that the heat exchange element 28 could take other forms and that the particular embodiment disclosed herein is merely representative of the type of element comprising a tube bank which lends itself to vortex shedding, tube vibration, or other cause for the creation of standing wave vibration.

Element 28 is made up of a plurality of sinuous tubes, each having straight sections 30 connected by curved sections 31. As the hot gases pass downwardly along the length dimension of the convection section duct and over tube sections 30, 31, vortex shedding may occur which in turn could produce pressure pulsations in a direction perpendicular to the flow of the hot gases and also perpendicular to walls 26. Tube sections 30, 31 may also be subjected to internal or external forces and start to vibrate, whereby pressure pulsations could also be created. Furthermore, turbulent flow of hot gases passing through convection section 16 may also create pressure pulsations which in turn could cause standing wave vibration.

Figure 2:
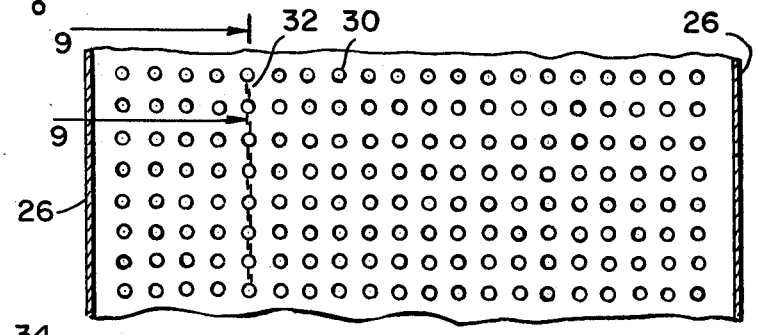
FIG. 2 is a sectional view taken along line 2—2 of FIG. 1, illustrating the orientation of tube sections within the rear gas pass and showing the anti-vibration fins of the instant invention.

Turning to FIG. 2, there is shown a sectional view of convection section 16. Tube sections 30, 31 are arranged in rows across the width of the convection section 16, with tube section centerlines being aligned vertically from row to row along the length of the convection section 16. In accordance with the present invention, fins 32 are welded to the outer surfaces of tube sections 30, 31 and arranged to provide a barrier between walls 26. Although not shown in FIG. 2, it is to be understood that fins 32 can be welded to curved tube sections 31 as shown in FIG. 13. "Columns" of the hot gases extend laterally across the convection section 16, being comprised of gas particles. The fins 32 are generally arranged so as to alter the dimension W of fluid columns extending across the convection section 16, whereby the standing wave frequency of particular columns is affected. The fins 32 shown in FIG. 2 are welded to the tube section and although adjacent fins may touch one another, they are free to move relative to one another. The fins can therefore slide across one another while maintaining a continuous barrier between walls 26 in the embodiment shown in FIG. 2. Although the barrier shown in FIG. 2 extends generally parallel to walls 26, it should be understood that a barrier can extend at an angle to the walls of the heat exchanger, as in FIG. 3. When the operating conditions of the heat exchanger, in this case the convection section 16 of steam generator 10, are known, then the locations for the fins 32 can be determined and the formation of standing wave vibration can thereby be minimized or altogether eliminated.

Figure 3:
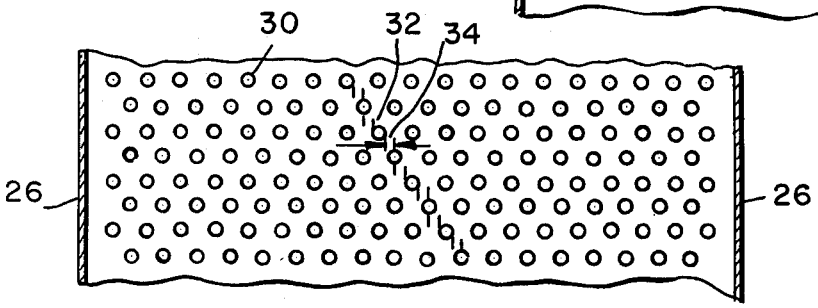
FIG. 3 is a sectional view similar to FIG. 2 but showing an alternative arrangement of the fins of the invention which are staggered across the gas pass area.

In FIG. 3 there is shown another sectional view similar to that of FIG. 2. In this view the tube sections 30 and fins 32 are staggered across the width of convection section 16 as they run down the length of section 16. It can be appreciated that such a tube array would not allow for placing a baffle vertically within convection section 16. Fins 32 are not arranged to provide a continuous barrier; openings 34 exist between adjacent fins 32. With respect to lateral columns of fluid that are interrupted by a fin 32, this embodiment would have the effect of altering the dimension W associated with such columns. However, some fluid columns may not be completely interrupted from lateral movement, since openings 34 could permit movement of fluid therethrough. The fluid columns which would tend to move through openings 34 are nonetheless affected by the presence of the fins 32 since the relatively small size of openings 34 creates resistance to fluid movement. This has the effect of dampening the amplitude or intensity of any standing wave that could be created by movement of fluid through openings 34. Indeed, in some cases the exciting energy necessary to overcome the resistance created by the small openings 34 may exceed the amount of exciting energy available and therefore no standing wave may result even though an opening 34 exists. Furthermore, the volume of the fluid associated with any standing wave created as a result of movement of fluid through an opening 34 would be so small that the effect of such a standing wave would be negligible. It is to be understood that the barrier can be defined by tubes to which a single fin is connected, tubes to which a plurality of fins are connected, or even a combination, of single and plural fin bearing tubes.

FIG. 4 is a view similar to FIG. 3, demonstrating that a plurality of barriers can be used and that one or more of the barriers need not extend completely through the tube bundle. It should be understood that a plurality of barriers, which each do or do not extend completely through the tube bundle can also be used. Furthermore, the barriers need not extend parallel to one another. The fins 32*a* are arranged to present a barrier extending only partially through the tube bundle. A partial barrier could be used when the exciting frequency associated with fluid columns existing beyond either extremity of the barrier would not equal or approach the natural frequency of the fluid columns at such locations. In the case of the FIG. 4 embodiment, it would have been determined before installation of fins 32 that two barriers were necessary to suppress standing wave vibration in the region of the lower five lateral rows of tube sections 30, while only a single barrier was needed thereabove. The location of fins 32 at particular distances from walls 26 would have been determined by the variables, such as fluid temperature and fluid column width, affecting standing wave frequencies.

The arrangement of FIG. 5 is similar to that of FIG. 2 except that fins 32 do not touch one another, and therefore a continuous barrier is not presented. FIG. 6 depicts an embodiment in which fins 32 are generally tangential to the tube surface, extending parallel to the direction of gas flow. In FIG. 7 the fins are aligned in the direction of gas flow and nearly abut one another. FIG. 8 shows an arrangement in which, because of close spacing of tube sections 30, only a single fin 32 is used between tube sections 30. It should be understood that the orientation of fins 32 will depend upon the direction of extension of the standing waves, that is, the direction of the pressure pulsations. In some cases, pressure pulsations may propagate through the heat exchange fluid which passes over the tubes in several different directions, and the fins may take various forms. For example, the fins 32 may take the form of helices wrapped around a tube. Furthermore, tube orientation and shape will also influence the form which the fins may take. In the case as shown in FIG. 13, the fins are not of uniform shape or size because of the shape of the tubes at the location of a bend.

FIG. 9 shows a sectional view taken along line 9—9 of FIG. 2. In this embodiment, continuous fins 32 are arranged along the length of tube sections 30.

The fins 32 are welded to the tube sections 30 and therefore allow for heat transfer between the fin and the tube. In this way the fins are cooled by a second fluid which passes through the tubes of heat exchange element 28. When the continuous fin arrangement is used, the dimension "p" of the fin 32 is limited by the temperature difference between fin 32 and the tube to which it is attached. It should be understood that in the particular embodiment described herein the first fluid flowing over the outer surface of the tube sections 30 is at a higher temperature than the second fluid passing through the tube sections 30, but the instant invention will have application regardless of whether the first or second fluid is hotter than the other. Fins 32, because they are cooled as a result of heat transfer with tube sections 30, overcome the problems of buckling, burning, or corroding attendant to baffles.

FIG. 10 is similar to FIG. 9 except that a plurality of small fins 32 are used. This arrangement is intended to alleviate thermal stresses at the fin to tube junctions.

In FIG. 11, there is shown an alternative fin arrangement. Rather than using a plurality of relatively small fins 32 along the length of tube sections 30, a continuous slotted fin 32 is employed. The slotted fin acts to alleviate thermal stresses at the fin-to-tube junction in a manner similar to the plurality of fins 32 arrangement.

FIG. 12 is a sectional view taken along line 12—12, wherein a plurality of in-line small fins 32 are used. It is to be understood that for the in-line fin arrangment, continuous fins can be used in lieu of or in combination with small fins 32.

In FIG. 13, a fin and tube arrangement at the location of a tube bend is shown. In this figure, a plurality of small fins 32 is used, but it should be understood that fins 32 could comprise slotted or continuous fins or a combination of slotted, small, or continuous fins.

In operation, a first heat exchange fluid, such as a heated gas, being shown by the arrows in FIG. 1 rises in furnace section 12, passes through vestibule section 14, passes down convection section 16 and is removed through outlet 20. A second heat exchange fluid, such as water, is passed through heat exchange element 28 and comes in indirect contact with the heated gas passing over element 28, thereby cooling the fins 32 and tube section 30. The convection section 16 is defined by front wall 22, rear wall 24, and a pair of side walls 26, and acts as a chamber for containing the first heat exchange fluid as it passes over heat exchange element 28. Element 28 comprises a bundle or bank of sinuous tubes, each including a plurality of laterally extending straight sections 30 connected by curved tube sections 31. The tube sections can be aligned laterally or vertically, or in both directions. For any of several reasons, including vortex shedding, turbulence or tube vibration, pressure pulsations propagate through the first heat exchange medium. Laterally extending columns of the first fluid are excited by these pressure pulsations and tend to form a standing wave pattern. However, fins 32 prevent the migration of fluid particules and thereby prevent such particles from forming into standing waves. Where openings exist between fins 32 and tube sections 30, as in the cases of the embodiments of 3–8, the openings are so sized as to dampen the amplitude of any resulting standing wave. Indeed, if the available exciting energy is not sufficient to overcome the resistance to fluid flow attributable to the small size of the openings, no standing wave may form. Since fins 32 are connected to the tube sections 30, 31, they are cooled by the second heat exchange fluid passing through the tube sections. Therefore, the fins are protected against buckling, burning and/or corroding.

A latitude of modification, change and substitution, is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A method of suppressing the formation of heat exchange fluid particles into standing waves, said heat exchange fluid being passed through a shell, and over a plurality of tube sections disposed transversely across said shell, to effect heat transfer between said fluid and said tube sections, said method comprising the steps of:

(a) disposing a plurality of metal fins within said shell, each of said fins extending parallel to a respective one of said tube sections and parallel to the direction of flow of said fluid through said shell;

(b) arranging said fins to define with at least some of said tube sections a barrier, said barrier being adapted to interrupt movement of laterally extending columns of said fluid particles in a direction perpendicular to the direction of flow of said fluid through said shell; and (c) connecting said fins to respective tube sections adjacent said fins, whereby said barriers affect the standing wave frequencies of said columns.

2. The method of claim 1, said plurality of tube sections comprising a plurality of straight sections connected by curved sections, said straight sections lying in a plane extending parallel to the direction of flow of said fluid wherein said step of arranging said fins to define with at least some of said tube sections a barrier comprises positioning said fins adjacent said straight sections such that said barrier extends parallel to the direction of flow of said fluid.

3. The method of claim 1, said plurality of tube sections comprising a plurality of spaced apart straight sections connected by curved sections, said straight sections arranged in columns along the length of said shell and rows extending laterally across said shell, wherein said step of arranging said fins comprises positioning fins adjacent straight tube sections within different columns and rows such that said barrier extends at an angle to the direction of flow of fluid through said shell.

4. The method of claim 1 wherein said step of arranging said fins comprises positioning fins adjacent tube sections to define with said tube sections a plurality of barriers arranged to interrupt movement of laterally extending columns of said fluid particles in a direction perpendicular to the direction of flow of said fluid through said shell.

* * * * *